US011817060B2

(12) United States Patent
Pan

(10) Patent No.: US 11,817,060 B2
(45) Date of Patent: Nov. 14, 2023

(54) DISPLAY PANEL AND DISPLAY METHOD THEREOF

(71) Applicant: Shenzhen China Star Optoelectronics Semiconductor Display Technology Co., Ltd., Shenzhen (CN)

(72) Inventor: Fang Pan, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 35 days.

(21) Appl. No.: 17/253,140

(22) PCT Filed: Apr. 22, 2020

(86) PCT No.: PCT/CN2020/086005
§ 371 (c)(1),
(2) Date: Dec. 17, 2020

(87) PCT Pub. No.: WO2021/203484
PCT Pub. Date: Oct. 14, 2021

(65) Prior Publication Data

US 2023/0022363 A1 Jan. 26, 2023

(30) Foreign Application Priority Data

Apr. 8, 2020 (CN) ..... 202010268927.9

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 2310/0264* (2013.01); *G09G 2320/0247* (2013.01); *G09G 2320/064* (2013.01)

(58) Field of Classification Search
CPC ..... G09G 3/3406; G09G 3/342; G09G 3/36; G09G 2310/0264; G09G 2320/0233; G09G 2320/0247; G09G 2320/062; G09G 2320/0626; G09G 2320/064
See application file for complete search history.

(56) References Cited

U.S. PATENT DOCUMENTS 8,139,019 B2 * 3/2012 Han ..... H05B 41/3927 345/204
8,300,004 B2 * 10/2012 Yeo ..... G09G 3/3648 345/102
9,495,896 B2 * 11/2016 Liu ..... G09G 3/2007
(Continued)

FOREIGN PATENT DOCUMENTS

CN 102157133 A 8/2011
CN 102592554 A 7/2012
(Continued)

*Primary Examiner* — Vijay Shankar
(74) *Attorney, Agent, or Firm* — Nathan & Associates; Menachem Nathan

(57) ABSTRACT

The present application provides a display panel and a display method thereof. The display method includes following steps: obtaining a real-time display frequency of a liquid crystal panel in response to a display operation of the display panel; and regulating backlight brightness of a backlight module according to the real-time display frequency, such that display brightness of the display panel is maintained within a target brightness range.

13 Claims, 4 Drawing Sheets

(56) References Cited

U.S. PATENT DOCUMENTS

| | | | | |
|---|---|---|---|---|
| 10,839,755 | B2 * | 11/2020 | Ha | G09G 3/3677 |
| 2008/0062105 | A1 * | 3/2008 | Han | H05B 41/3927 345/90 |
| 2010/0053228 | A1 | 3/2010 | Yeo et al. | |
| 2011/0134158 | A1 | 6/2011 | Onishi | |
| 2012/0182332 | A1 | 7/2012 | Liu | |
| 2019/0180695 | A1 * | 6/2019 | Ha | G09G 3/3291 |

FOREIGN PATENT DOCUMENTS

| | | | |
|---|---|---|---|
| CN | 102810297 | A | 12/2012 |
| CN | 108335677 | A | 7/2018 |
| CN | 108346406 | A | 7/2018 |
| CN | 108806620 | A | 11/2018 |
| CN | 109903725 | A | 6/2019 |
| EP | 1901590 | A1 | 3/2008 |

* cited by examiner

DISPLAY PANEL AND DISPLAY METHOD THEREOF

FIELD OF INVENTION

The present application relates to the field of display technology, and especially to a display panel and a display method thereof.

BACKGROUND OF INVENTION

Development of display technology has driven development of e-sports displays such as those applied in e-sports industry. In order to adapt to characteristics such as game screens' high refresh rates and frequency conversion, and prevent problems such as screen tearing, lags, etc., frequency conversion technologies such as G-Sync, FreeSync, etc. have successively been launched in the market. Such kind of technologies require displays to realize a frequency conversion function, and a frequency of display screens automatically matches a frequency of screens output by a graphics card. Currently, a highest refresh rate of e-sports displays reachable in the industry is 240 Hz, and higher rates may be developed in the future.

SUMMARY OF INVENTION

Currently, frequency conversion technology brings a problem. FIG. 1 is a signal diagram of frame pictures under different frequencies in the conventional frequency conversion technology. During a time of a low frequency's (e.g. 48 Hz) frame, a time of a vertical blanking interval (V-blank) at a black portion in FIG. 1 is longer than that of a high frequency's (e.g. 165 Hz) frame, an electrical leakage time of thin film transistors (TFTs) is lengthened, which leads to that transmittance of low-frequency liquid crystal panels (OC, Open Cell) is lower than that of high-frequency ones, and when displaying same pictures on a full display panel, brightness under low frequencies is lower than that under high frequencies, which leads to flickering pictures subjectively felt by human eyes.

Embodiments of the present application provide a display panel and a display method thereof to resolve a technical problem that when displaying same pictures on a full display panel, brightness under low frequencies is lower than that under high frequencies due to a fixed backlight brightness in the conventional frequency conversion display technology, which leads to flickering pictures subjectively felt by human eyes.

In order to resolve the above-mentioned problem, the present application provides following technical approaches.

A display method of a display panel, wherein the display panel includes a backlight module and a liquid crystal panel assembled with the backlight module, and the method includes: obtaining a real-time display frequency of the liquid crystal panel in response to a display operation of the display panel; and regulating backlight brightness of the backlight module according to the real-time display frequency such that display brightness of the display panel is maintained within a target brightness range.

In the display method of the display panel according to the present application, the step of regulating the backlight brightness of the backlight module according to the real-time display frequency includes: dividing a display frequency range of the liquid crystal panel into at least two frequency bands, and specifying each of the frequency bands to correspond to a specific backlight brightness; and regulating the backlight brightness into the specific backlight brightness to which one of the frequency bands that includes the real-time display frequency corresponds.

In the display method of the display panel according to the present application, in any two of the frequency bands, a brightness value of the specific backlight brightness to which one frequency band that includes higher display frequencies corresponds is less than a brightness value of the specific backlight brightness to which the other frequency band that includes lower display frequencies corresponds.

In the display method of the display panel according to the present application, a length of each of the frequency bands is equal.

In the display method of the display panel according to the present application, a number of the frequency bands is at least three, and brightness difference values of two of the specific backlight brightness to which any adjacent two of the frequency bands correspond are equal.

In the display method of the display panel according to the present application, before the step of regulating the backlight brightness into the specific backlight brightness to which one of the frequency bands that includes the real-time display frequency corresponds, the method further includes: comparing the real-time display frequency sequentially with a maximum frequency value and a minimum frequency value in each of the frequency bands, and when the real-time display frequency is greater than or equal to a minimum frequency value in one of the frequency bands and is less than a maximum frequency value in the one of the frequency bands, judging that the one of the frequency bands includes the real-time display frequency.

In the display method of the display panel according to the present application, a brightness value of each of the specific backlight brightness is within the target brightness range.

The present application further provides a display panel that includes a backlight module, a liquid crystal panel assembled with the backlight module, and a backlight controller connected to the backlight module and the liquid crystal panel, wherein the backlight controller obtains a real-time display frequency of the liquid crystal panel in response to a display operation of the display panel, and regulates backlight brightness of the backlight module according to the real-time display frequency such that display brightness of the display panel is maintained within a target brightness range.

In the display panel according to the present application, the backlight controller regulating the backlight brightness of the backlight module according to the real-time display frequency includes: dividing a display frequency range of the liquid crystal panel into at least two frequency bands, and specifying each of the frequency bands to correspond to a specific backlight brightness; and regulating the backlight brightness into the specific backlight brightness to which one of the frequency bands that includes the real-time display frequency corresponds.

In the display panel according to the present application, in any two of the frequency bands, the backlight controller controls a brightness value of the specific backlight brightness to which one frequency band that includes higher display frequencies corresponds to be less than a brightness value of the specific backlight brightness to which the other frequency band that includes lower display frequencies corresponds.

In the display panel according to the present application, a length of each of the frequency bands is equal.

In the display panel according to the present application, a number of the frequency bands is at least three, and the backlight controller controls brightness difference values of two of the specific backlight brightness to which any adjacent two of the frequency bands correspond to be equal.

In the display panel according to the present application, before the regulating the backlight brightness into the specific backlight brightness to which one of the frequency bands that includes the real-time display frequency corresponds, further comprising: the backlight controller comparing the real-time display frequency sequentially with a maximum frequency value and a minimum frequency value in each of the frequency bands, and when the real-time display frequency is greater than or equal to a minimum frequency value in one of the frequency bands and is less than a maximum frequency value in the one of the frequency bands, judging that the one of the frequency bands includes the real-time display frequency.

In the display panel according to the present application, a brightness value of each of the specific backlight brightness is within the target brightness range.

In the display panel according to the present application, the liquid crystal panel includes a driving integrated circuit (IC), and the backlight controller is integrated with the driving IC.

A beneficial effect of the present application is that through obtaining a real-time display frequency of the liquid crystal panel, and regulating backlight brightness of the backlight module according to the real-time display frequency, the present application maintains display brightness of the display panel within a target brightness range such that a problem of flickering pictures subjectively felt by human eyes due to different transmittance of the liquid crystal panel under different display frequencies is prevented.

DESCRIPTION OF DRAWINGS

The accompanying figures to be used in the description of embodiments of the present application will be described in brief to more clearly illustrate the technical solutions of the embodiments. The accompanying figures described below are only part of the embodiments of the present application, from which those skilled in the art can derive further figures without making any inventive efforts.

DETAILED DESCRIPTION OF PREFERRED EMBODIMENTS

Figure 1:
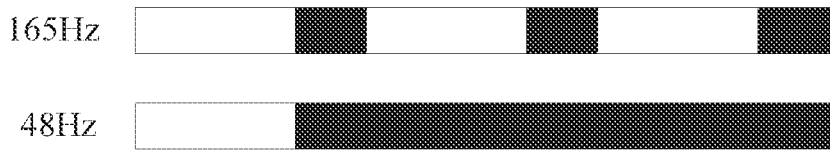
FIG. 1 PRIOR ART
FIG. 1 is a signal diagram of frame pictures under different frequencies in conventional frequency conversion technology.

The embodiments of the present application are described in detail hereinafter. Examples of the described embodiments are given in the accompanying drawings. In the description of the present application, it should be understood that terms such as "upper," "lower," "front," "rear," "left," "right," "inside," "outside," as well as derivative thereof should be construed to refer to the orientation as shown in the drawings under discussion. These relative terms are for convenience of description and shall not be construed as causing limitations to the present application. The identical reference numerals constantly denote the similar elements.

In description of the present application, it should be understood that terms that indicates orientation or relation of position such as "center", "longitudinal", "lateral", "length", "width", "thickness", "upper", "lower", "front", "rear", "left", "right", "vertical", "horizontal", "top", "bottom", "interior", "exterior", "clockwise", "counterclockwise" are based on orientation or relation of position accompanying drawings show. They are simply for purpose of description of the present application and simplifying of description, and do not mean or suggest the devices or components have a specified orientation and constructed and operated in a specified orientation; therefore, it should not be understood as limitation of the present application. Furthermore, terms "first" and "second" are used simply for purpose of description and cannot be understood to mean or suggest relative importance or implicitly mean amount of the technical features. Therefore, features with terms "first" and "second" can mean or implicitly include one or more of the features. In description of the present application, "multiple" means two or more unless otherwise clearly and concretely specified.

In description of the present application, unless otherwise clearly defined or specified, it should be explained that terms such as "mount", "connect", "secure", etc. should be understood in a wide sense. For example, it can be fixedly connected, detachably connected, or one-piece; it can be mechanically connected, electrically connected, or mutually communicable; it can be directly connected or indirectly connected through an intermediate media; and it can be an internal connection of two devices or effect relation of two devices to each other. For a person of ordinary skill in the art, specific meaning of the above-mentioned terms in the present application can be understood according to specific conditions.

In the present application, unless otherwise clearly specified and limited, that a first feature is "on" or "below" a second feature can include that the first feature directly contacts the second feature, and also can include that the first feature contacts the second feature through other features between them rather than their direct contact. Furthermore, that a first feature is "on top of", "above", and "on an upper side of" a second feature includes that the first feature is on right top of and obliquely above the second feature, or merely means that a horizontal height of the first feature is greater than that of the second feature. That a first feature is "at a bottom of", "below", and "on an lower side of" a second feature includes that the first feature is at the right bottom of and obliquely below the second feature, or merely means that a horizontal height of the first feature is less than that of the second feature.

Contents disclosed below provide many different embodiments or examples to realize different structures according to the present application. For the purpose of simplifying description of the present application, contents below describe parts and configuration of specific examples. Naturally, they are merely for illustration and do not intend to limit the present application. Furthermore, reference numerals and/or letters can be repeated in different examples of the present application, and this repeat is for the purse of simplification and clearness, not indicating relations between various embodiments and/or configurations under discussion. Furthermore, the present application provides examples of various specific processes and materials; however, a person of ordinary skill in the art can think of applications of other processes and/or materials.

Technical approaches of the present application are described now with reference to specific embodiments.

Figure 2:
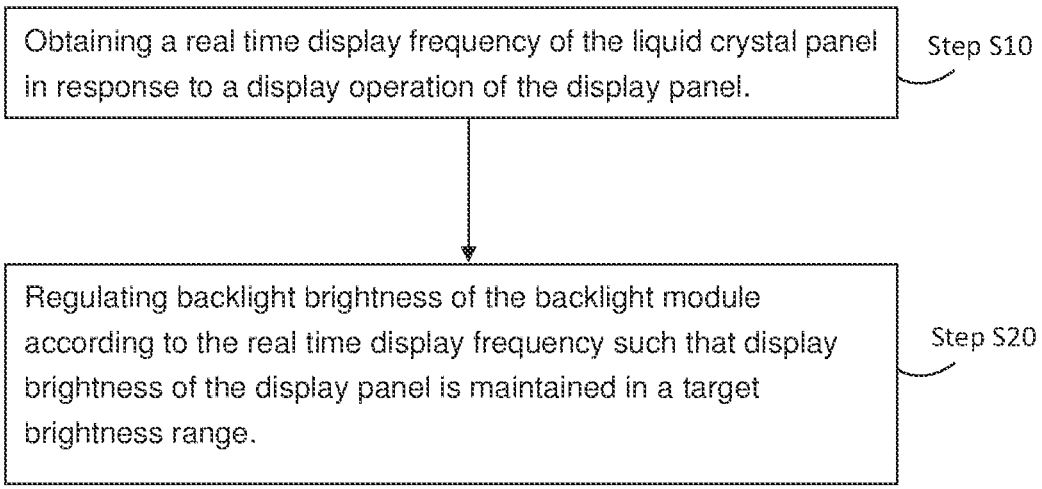
FIG. 2 is a flowchart of a display method of a display panel according to an embodiment of the present application.

The present application provides a display method of a display panel, as shown in FIG. 2. The display panel includes a backlight module and a liquid crystal panel assembled with the backlight module. The method includes following steps:

Step S10: obtaining a real-time display frequency of the liquid crystal panel in response to a display operation of the display panel; and Step S20: regulating backlight brightness of the backlight module according to the real-time display frequency such that display brightness of the display panel is maintained within a target brightness range.

It can be understood that, in application of the conventional frequency conversion technology, during a course of frequency conversion display of a display panel, switches between different display frequencies make transmittance of the liquid crystal panel in the display panel different, while the backlight unit (BLU) in the display panel always maintains a fixed backlight brightness, which finally leads to flickering pictures presented by the display panel subjectively felt by users. Obviously, through obtaining the real-time display frequency of the liquid crystal panel in step S10, and then in combination with regulating the backlight brightness of the backlight module according to the real-time display frequency in step S20, the present application realizes a real-time regulation of the backlight brightness according to the different real-time display frequency, and substantially prevents a problem of flickering pictures of the display panel subjectively felt by human eyes. Specifically, a method of obtaining the real-time display frequency of the liquid crystal panel can not only be through scan lines in the liquid crystal panel, but also from components in the liquid crystal panel such as a driving integrated circuit (IC), which is not limited thereto. Furthermore, the target brightness range can be regulated according to specific requirements, so long as it does not make a user subjectively feel flickering pictures.

In one embodiment, the step of regulating the backlight brightness of the backlight module according to the real-time display frequency includes:

Step S21: dividing a display frequency range of the liquid crystal panel into at least two frequency bands, and specifying each of the frequency bands to correspond to a specific backlight brightness; and Step S23: regulating the backlight brightness into the specific backlight brightness to which one of the frequency bands that includes the real-time display frequency corresponds.

It can be understood that through dividing the display frequency range of the liquid crystal panel into at least two frequency bands, and specifying each of the frequency bands to correspond to a specific backlight brightness, control of the backlight brightness according to divided frequency bands is realized, and a control flow is simplified. Obviously, a brightness value of each of the specific backlight brightness is within the target brightness range.

In one embodiment, in any two of the frequency bands, a brightness value of the specific backlight brightness to which one frequency band that includes higher display frequencies corresponds is less than a brightness value of the specific backlight brightness to which the other frequency band that includes lower display frequencies corresponds. Obviously, as shown in FIG. 1, lower display frequencies correspond to lower transmittance of the liquid crystal display panel, and higher display frequencies correspond to higher transmittance of the liquid crystal display panel. Through regulating the backlight brightness of lower display frequencies to be greater than that of higher display frequencies, display brightness difference of the full display panel under different conditions of the display frequencies is decreased, and an overall display is more uniform.

Specifically, a length of each of the frequency bands is equal. Furthermore, when a number of the frequency bands is at least three, brightness difference values of two of the specific backlight brightness to which any adjacent two of the frequency bands correspond are equal, which therefore substantially ensures division uniformity of display frequency range of the liquid crystal panel, and further making transition between each of the specific backlight brightness more uniform.

In one embodiment, before the step of regulating the backlight brightness into the specific backlight brightness to which one of the frequency bands that includes the real-time display frequency corresponds, the method further includes:

Step S22: comparing the real-time display frequency sequentially with a maximum frequency value and a minimum frequency value in each of the frequency bands, and when the real-time display frequency is greater than or equal to a minimum frequency value in one of the frequency bands and is less than a maximum frequency value in the one of the frequency bands, judging that the one of the frequency bands includes the real-time display frequency. Through this kind of comparison method, which one of the frequency bands the real-time display frequency belongs to is more conveniently and efficiently judged, which benefits following regulation of the backlight brightness.

Figure 3:
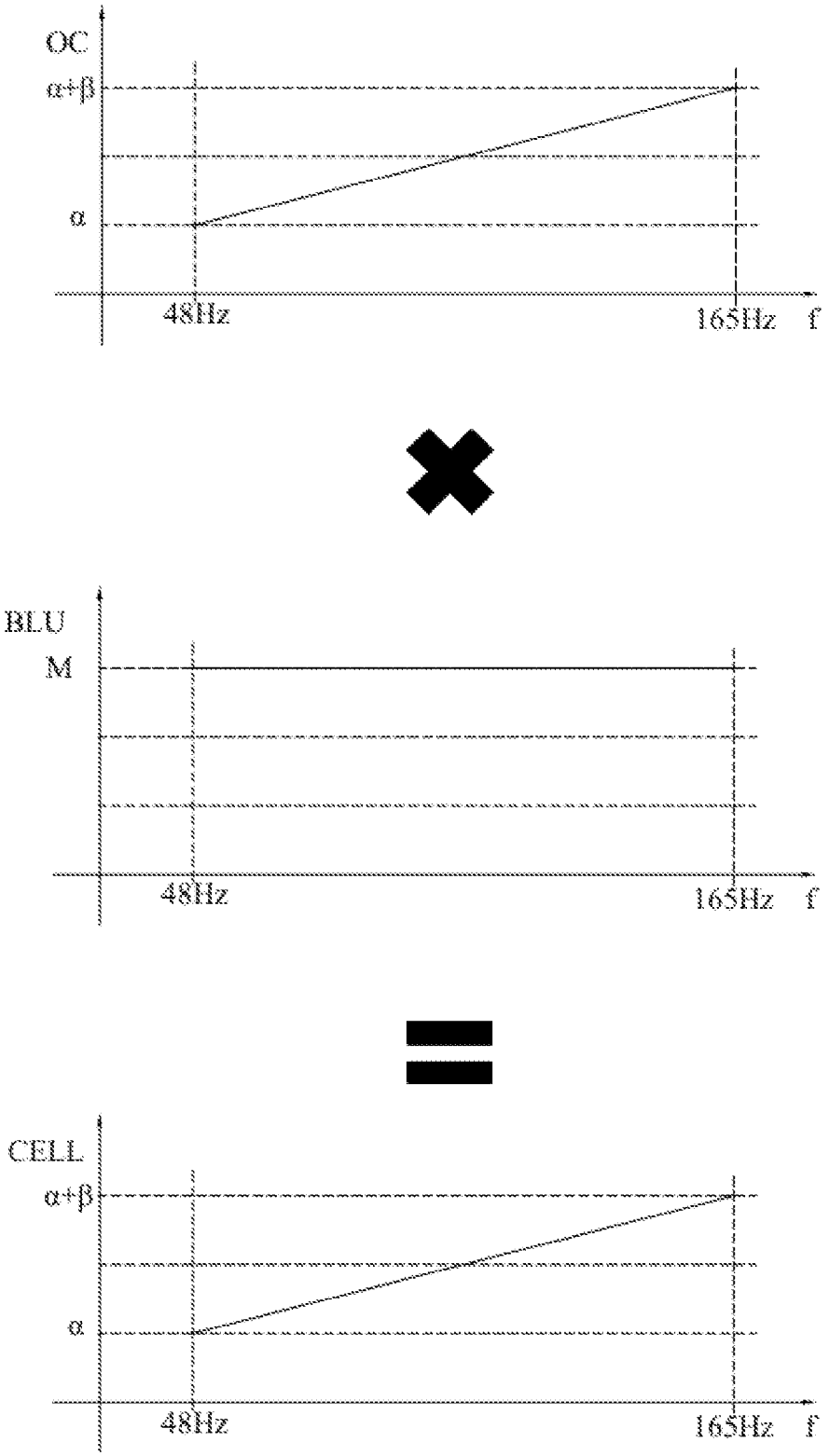
FIG. 3 is a schematic diagram of a display brightness range when a frequency conversion controlled liquid crystal panel is combined with a backlight module with a fixed backlight brightness in conventional technology.
Figure 4:
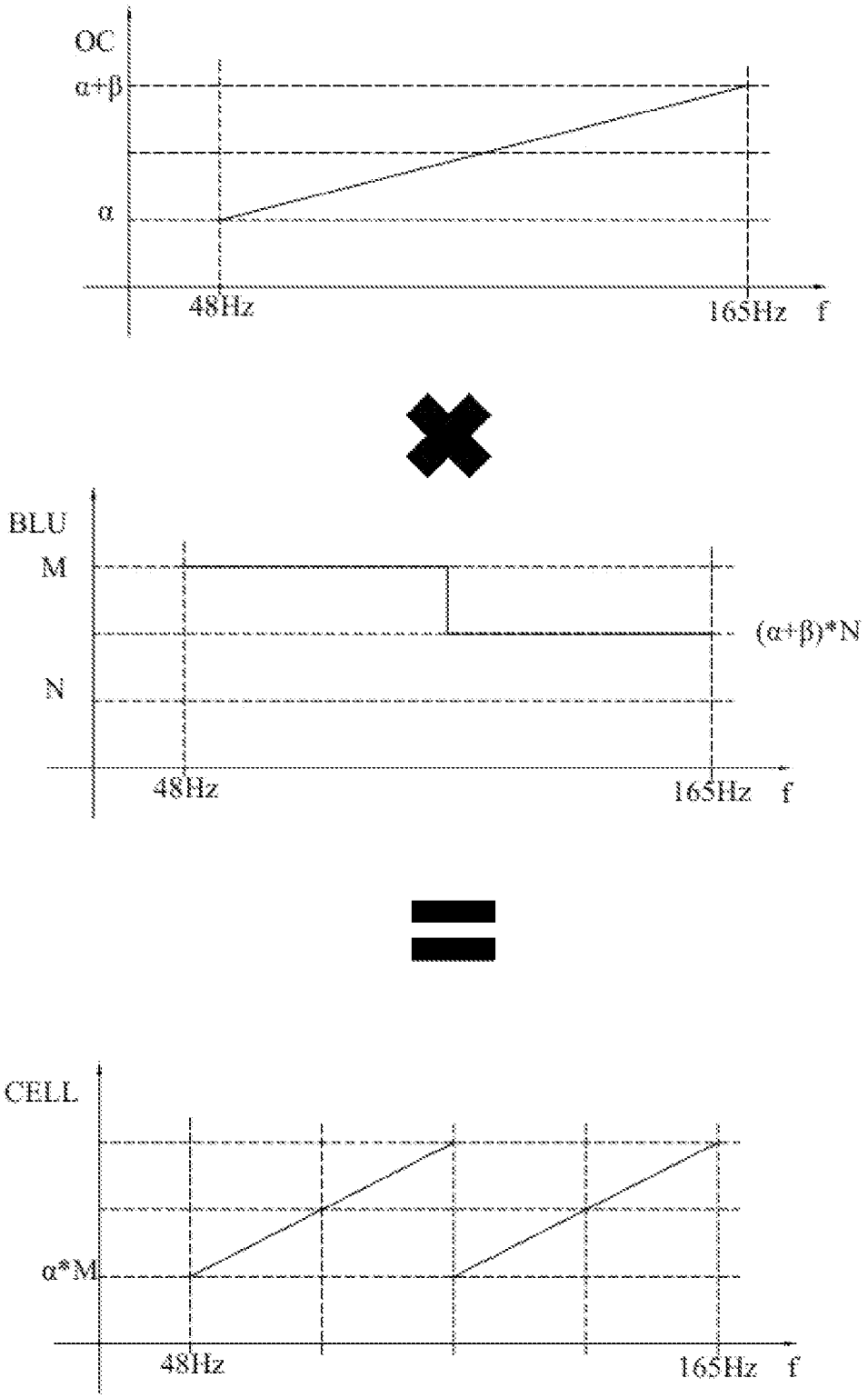
FIG. 4 is a schematic diagram of a display brightness range when a frequency conversion controlled liquid crystal panel is combined with a backlight module with a variable backlight brightness according to the present application.

Specifically, as shown in FIG. 4, dividing a display frequency range of the liquid crystal panel into two frequency bands, and specifying each of the frequency bands to correspond to a specific backlight brightness. Wherein, the display frequency range of the liquid crystal panel is 48 Hz-165 Hz, and the two frequency bands are 48 Hz-106.5 Hz and 106.5 Hz-165 Hz, respectively. Furthermore, as shown in FIG. 4, a brightness value of the specific backlight brightness M the lower frequency band of 48 Hz-106.5 Hz corresponds to is greater than that of the specific backlight brightness N the higher frequency band of 106.5 Hz-165 Hz corresponds to. FIG. 3 is a schematic diagram of the display brightness range under a condition of the backlight module with a fixed backlight brightness. Obviously, as shown in FIG. 4, a brightness display range under a backlight brightness regulation of the present application is apparently narrower, which prevents a problem of flickering display pictures subjectively felt by human eyes.

Figure 5:
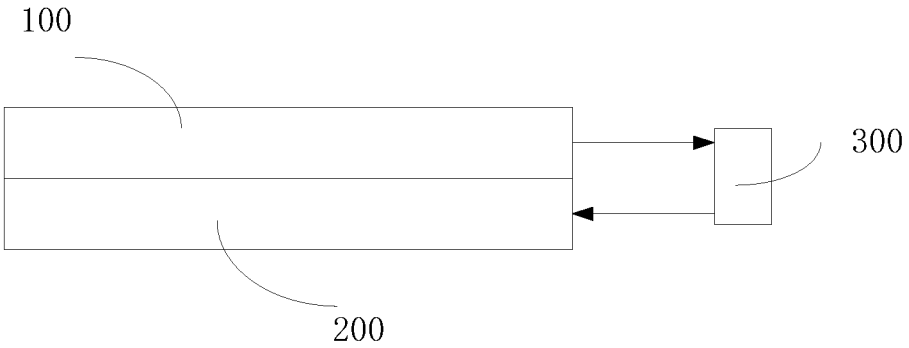
FIG. 5 is a functional module schematic diagram of a display panel according to an embodiment of the present application.

The present application further provides a display panel, as shown in FIG. 5, that includes a backlight module 200, a liquid crystal panel 100 assembled with the backlight module 200, and a backlight controller 300 connected to the backlight module 200 and the liquid crystal panel 100. The backlight controller 300 obtains a real-time display frequency of the liquid crystal panel 100 in response to a display operation of the display panel, and regulates backlight brightness of the backlight module 200 according to the real-time display frequency such that display brightness of the display panel is maintained within a target brightness range. It can be understood that the backlight module 200 and the liquid crystal panel 100 are of regular structures, and specifically the backlight controller 300 can be embedded into the display panel according to practical requirements.

In one embodiment, the backlight controller 300 regulating backlight brightness of the backlight module 200 according to the real-time display frequency includes:

dividing a display frequency range of the liquid crystal panel 100 into at least two frequency bands, and specifying each of the frequency bands to correspond to a specific backlight brightness; and regulating the backlight brightness into the specific backlight brightness to which one of the frequency bands that includes the real-time display frequency corresponds.

In one embodiment, the liquid crystal panel 100 includes a driving IC (not shown), and the backlight controller 300 is integrated with the driving IC. Obviously, through integrating the backlight controller 300 with the driving IC, the backlight controller 300 can not only be an independent control unit, but also be a control unit as a part of the driving IC such that the display panel gains better integrity.

A beneficial effect of the present application is that through obtaining a real-time display frequency of the liquid crystal panel 100, and regulating backlight brightness of the backlight module 200 according to the real-time display frequency, display brightness of the display panel is maintained within a target brightness range such that a problem of flickering pictures subjectively felt by human eyes due to different transmittance of the liquid crystal panel 100 under different display frequencies is prevented.

Although the present application has been explained in relation to its preferred embodiment, it does not intend to limit the present application. It will be apparent to those skilled in the art having regard to this present application that other modifications of the exemplary embodiments beyond those embodiments specifically described here may be made without departing from the spirit of the application. Accordingly, such modifications are considered within the scope of the application as limited solely by the appended claims.

What is claimed is:

1. A display method of a display panel, wherein the display panel comprises a backlight module and a liquid crystal panel assembled with the backlight module, and the method comprises following steps:

obtaining a real-time display frequency of the liquid crystal panel in response to a display operation of the display panel; and regulating backlight brightness of the backlight module according to the real-time display frequency, such that display brightness of the display panel is maintained within a target brightness range, wherein the step of regulating the backlight brightness of the backlight module according to the real-time display frequency comprises:

dividing a display frequency range of the liquid crystal panel into at least two frequency bands, and specifying each of the frequency bands to correspond to a specific backlight brightness; and regulating the backlight brightness into the specific backlight brightness to which one of the frequency bands that includes the real-time display frequency corresponds.

2. The display method of the display panel as claimed in claim 1, wherein in any two of the frequency bands, a brightness value of the specific backlight brightness to which one frequency band that includes higher display frequencies corresponds is less than a brightness value of the specific backlight brightness to which the other frequency band that includes lower display frequencies corresponds.

3. The display method of the display panel as claimed in claim 2, wherein a length of each of the frequency bands is equal.

4. The display method of the display panel as claimed in claim 3, wherein a number of the frequency bands is at least three, and brightness difference values of two of the specific backlight brightness to which any adjacent two of the frequency bands correspond are equal.

5. The display method of the display panel as claimed in claim 1, wherein before the step of regulating the backlight brightness into the specific backlight brightness to which one of the frequency bands that includes the real-time display frequency corresponds, the method further comprises:

comparing the real-time display frequency sequentially with a maximum frequency value and a minimum frequency value in each of the frequency bands, and when the real-time display frequency is greater than or equal to a minimum frequency value in one of the frequency bands and is less than a maximum frequency value in the one of the frequency bands, judging that the one of the frequency bands includes the real-time display frequency.

6. The display method of the display panel as claimed in claim 1, wherein a brightness value of each of the specific backlight brightness is within the target brightness range.

7. A display panel, comprising a backlight module, a liquid crystal panel assembled with the backlight module, and a backlight controller connected to the backlight module and the liquid crystal panel, wherein the backlight controller obtains a real-time display frequency of the liquid crystal panel in response to a display operation of the display panel, and regulates backlight brightness of the backlight module according to the real-time display frequency, such that display brightness of the display panel is maintained within a target brightness range, wherein the backlight controller regulating the backlight brightness of the backlight module according to the real-time display frequency comprises:

dividing a display frequency range of the liquid crystal panel into at least two frequency bands, and specifying each of the frequency bands to correspond to a specific backlight brightness; and regulating the backlight brightness into the specific backlight brightness to which one of the frequency bands that includes the real-time display frequency corresponds.

8. The display panel as claimed in claim 7, wherein in any two of the frequency bands, the backlight controller controls a brightness value of the specific backlight brightness to which one frequency band that includes higher display frequencies corresponds to be less than a brightness value of the specific backlight brightness to which the other frequency band that includes lower display frequencies corresponds.

9. The display panel as claimed in claim 8, wherein a length of each of the frequency bands is equal.

10. The display panel as claimed in claim 9, wherein a number of the frequency bands is at least three, and the backlight controller controls brightness difference values of two of the specific backlight brightness to which any adjacent two of the frequency bands correspond to be equal.

11. The display panel as claimed in claim 7, wherein before the regulating the backlight brightness into the specific backlight brightness to which one of the frequency bands that includes the real-time display frequency corresponds, further comprising:

the backlight controller comparing the real-time display frequency sequentially with a maximum frequency value and a minimum frequency value in each of the frequency bands, and when the real-time display frequency is greater than or equal to a minimum frequency value in one of the frequency bands and is less than a maximum frequency value in the one of the frequency bands, judging that the one of the frequency bands includes the real-time display frequency.

12. The display panel as claimed in claim 7, wherein a brightness value of each of the specific backlight brightness is within the target brightness range.

13. The display panel as claimed in claim 7, wherein the liquid crystal panel comprises a driving integrated circuit (IC), and the backlight controller is integrated with the driving IC.

* * * * *